US008561977B2

(12) United States Patent
Chang

(10) Patent No.: US 8,561,977 B2
(45) Date of Patent: Oct. 22, 2013

(54) POST-PROCESSING APPARATUS WITH SHEET EJECTION DEVICE

(75) Inventor: Yu-Lun Chang, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 13/470,912

(22) Filed: May 14, 2012

(65) Prior Publication Data

US 2013/0221609 A1 Aug. 29, 2013

(30) Foreign Application Priority Data

Feb. 24, 2012 (TW) ..... 101106202 A

(51) Int. Cl.
*B65H 39/043* (2006.01)

(52) U.S. Cl.
USPC ..... 270/58.07; 270/58.11; 270/58.12; 414/790.3

(58) Field of Classification Search
USPC ..... 270/58.07, 58.08, 58.11, 58.12; 414/790.3
See application file for complete search history.

(56) References Cited

U.S. PATENT DOCUMENTS

| | | | | |
|---|---|---|---|---|
| 5,382,011 | A * | 1/1995 | Tani | 270/37 |
| 5,545,000 | A * | 8/1996 | Gorsky | 414/790.3 |
| 7,445,203 | B2 * | 11/2008 | Kaneko | 270/58.08 |
| 7,487,959 | B2 * | 2/2009 | Noh | 270/58.12 |
| 7,798,480 | B2 * | 9/2010 | Kikkawa et al. | 270/58.12 |
| 7,954,802 | B2 * | 6/2011 | Mizutani et al. | 270/58.12 |
| 7,984,900 | B2 * | 7/2011 | Terao et al. | 270/58.12 |
| 7,992,856 | B2 * | 8/2011 | Saito | 270/58.11 |
| 8,220,794 | B2 * | 7/2012 | Terao et al. | 270/58.09 |
| 2012/0032388 | A1 * | 2/2012 | Jung | 270/58.08 |

* cited by examiner

*Primary Examiner* — Kaitlin S Joerger
*Assistant Examiner* — Ernesto Suarez
(74) *Attorney, Agent, or Firm* — Kirton McConkie; Evan R. Witt

(57) ABSTRACT

A post-processing apparatus with a sheet ejection device includes a first sheet tray, a second sheet tray, and a sheet ejection arm. The sheet ejection arm includes a first pushing element and a second pushing element. The second pushing element is pivotally coupled to the first pushing element. The tail edges of the plural paper sheets are pushed by the sheet ejection arm from the first end of the first sheet tray, so that the plural paper sheets are moved toward the second end of the first sheet tray. When the tail edges of the plural paper sheets reach the second end of the first sheet tray, the second pushing element is swung toward the second sheet tray to press the tail edges of the plural paper sheets, so that the plural paper sheets are aligned with each other and smoothly fallen down to the second sheet tray.

8 Claims, 12 Drawing Sheets

POST-PROCESSING APPARATUS WITH SHEET EJECTION DEVICE

FIELD OF THE INVENTION

The present invention relates to a post-processing apparatus, and more particularly to a post-processing apparatus with a sheet ejection device.

BACKGROUND OF THE INVENTION

An office machine such as a printer or a scanner is widely used in the office. For achieving diversified functions and integrating more functions, the office machine is usually equipped with a post-processing apparatus. By the post-processing apparatus, plural documents outputted from the printer or the scanner can be automatically stapled or punched in order to enhance the working efficiency. Regardless of whether any task is performed, the document outputted from the office machine with the post-processing apparatus is firstly introduced into a first sheet tray of the post-processing apparatus, and finally ejected to a second sheet tray outside the office machine through the a sheet ejection device.

Hereinafter, the structure of a conventional post-processing apparatus will be illustrated with reference to FIGS. 1 and 2. FIG. 1 is a schematic perspective view illustrating a conventional post-processing apparatus. FIG. 2 is a schematic side view illustrating the conventional post-processing apparatus.

Please refer to FIGS. 1 and 2. The post-processing apparatus 1 comprises a first sheet tray 11, a second sheet tray 12, and a sheet ejection device 13. The first sheet tray 11 has a first end 11*a* and a second end 11*b*. The sheet ejection device 13 comprises a ring-shaped conveyor belt 13*a*, a sheet ejection arm 13*b*, a first roller 13*c*, and a second roller 13*d*.

The second sheet tray 12 is located beside the second end 11*b* of the first sheet tray 11. The first roller 13*c* is disposed under the first end 11*a* of the first sheet tray 11. The second roller 13*d* is disposed under the second end 11*b* of the first sheet tray 11. The first roller 13*c* and the second roller 13*d* are enclosed by the ring-shaped conveyor belt 13*a*. In addition, the sheet ejection arm 13*b* is protruded from an outer surface of the ring-shaped conveyor belt 13*a*.

Hereinafter, the operations of the conventional sheet ejection device will be illustrated with reference to FIGS. 3A, 3B and 3C. FIG. 3A is a schematic side view illustrating the conventional post-processing apparatus, in which the sheet ejection device is in an initial position. FIG. 3B is a schematic side view illustrating the conventional post-processing apparatus, in which plural paper sheets are pushed by the sheet ejection device. FIG. 3C is a schematic side view illustrating the conventional post-processing apparatus, in which the tail edges of the plural paper sheets are moved to the second end of the first sheet tray.

After plural paper sheets S are introduced into the first sheet tray 11 through the first end 11*a* of the first sheet tray 11, the paper sheets S are sequentially stacked on the first sheet tray 11.

Before a sheet-ejecting operation is performed, the ring-shaped conveyor belt 13*a* is in a static state. Under this circumstance, the sheet ejection arm 13*b* is stayed in an initial position, which is located under the first sheet tray 11 (see FIG. 3A).

Once the sheet-ejecting operation is started, the second roller 13*d* is rotated. Upon rotation of the second roller 13*d*, the ring-shaped conveyor belt 13*a* and the sheet ejection arm 13*b* are simultaneously and circularly moved, and the first roller 13*c* is driven to be rotated.

Consequently, the sheet ejection arm 13*b* moved upwardly from the initial position. In addition, the sheet ejection arm 13*b* is exposed to the surface of the first sheet tray 11 from the first end 11*a* of the first sheet tray 11, so that the tail edges of the plural paper sheets S are pushed by the sheet ejection arm 13*b* (see FIG. 3B).

The sheet ejection arm 13*b* is continuously moved toward the second end 11*b* of the first sheet tray 11, so that the plural paper sheets S are moved in the direction toward the second sheet tray 12.

When the sheet ejection arm 13*b* and the tail edges of the plural paper sheets S reach the second end 11*b* of the first sheet tray 11 (see FIG. 3C), a pushing force in the direction x is exerted on the plural paper sheets S. Moreover, due to the gravity of the plural paper sheets S, the plural paper sheets S are fallen down to the second sheet tray 12. The sheet ejection arm 13*b* is continuously moved downwardly, and finally returned to the initial position.

The sheet ejection device of the post-processing apparatus, however, still has some drawbacks. For example, when the tail edges of the plural paper sheets reach the second end of the first sheet tray, the plural paper sheets have been completely detached from the first sheet tray, but the pushing force in the direction x is still exerted on the plural paper sheets. If no instantaneous downward force is exerted on the plural paper sheets to allow the tail edges of the plural paper sheets to be quickly introduced into the second sheet tray, the plural paper sheets may easily fly in the sheet-pushing direction of the sheet ejection arm. Under this circumstance, the plural paper sheets fail to be uniformly aligned with each other.

If the moving speed of the sheet ejection arm is increased to enhance the overall working efficiency, the above problems become more serious.

Therefore, there is a need of providing a post-processing apparatus with an improved sheet ejection device in order to eliminate the drawbacks encountered from the prior art.

SUMMARY OF THE INVENTION

The present invention provides a sheet ejection device for allowing the paper sheets to be aligned with each other and smoothly fallen down to the sheet tray.

In accordance with an aspect of the present invention, there is provided a post-processing apparatus with a sheet ejection device for an office machine. The post-processing apparatus further includes a first sheet tray and a second sheet tray. The first sheet tray is used for storing plural paper sheets. The first sheet tray includes an elongated groove. The elongated groove is extended from a first end of the first sheet tray to a second end of the first sheet tray. The second sheet tray is located beside the second end of the first sheet tray. The sheet ejection device is used for transmitting the plural paper sheets from the first sheet tray to the second sheet tray. The sheet ejection device includes a ring-shaped conveyor belt, a driving device, and a sheet ejection arm. The ring-shaped conveyor belt is disposed under the elongated groove of the first sheet tray. The driving device is used for driving a circular movement of the ring-shaped conveyor belt. The sheet ejection arm is movable with the ring-shaped conveyor belt, so that the sheet ejection arm is penetrated through the elongated groove, and moved from the first end of the first sheet tray to the second end of the first sheet tray. The sheet ejection arm includes a first pushing element and a second pushing element. The first pushing element is protruded from a surface of the ring-shaped conveyor belt. The second pushing element is pivotally coupled to the first pushing element and permitted to be swung relative to the first pushing element. After the sheet ejection arm is penetrated through the elongated groove from the first end of the first sheet tray, tail edges of the plural paper sheets are pushed by the sheet ejection arm, so that the plural paper sheets are moved toward the second end of the first sheet tray. When the tail edges of the plural paper sheets reach the second end of the first sheet tray, the second pushing element is swung toward the second sheet tray to press the tail edges of the plural paper sheets, so that the plural paper sheets are aligned with each other and smoothly fallen down to the second sheet tray.

In an embodiment, the first pushing element further includes a stopper, which is extended from a tip of the first pushing element.

In an embodiment, the second pushing element includes a sidewall, a bulge, a notch, and two coupling blocks. The sidewall is used for contacting and pushing the plural paper sheets. A hook is formed on a tip of the sidewall for preventing the plural paper sheets from being escaped out of a top side of the second pushing element. The bulge is protruded from an opposite surface of the sidewall. The notch is disposed under the bulge. The two coupling blocks are located at a bottom of the second pushing element. The two coupling blocks are coupled to the stopper of the first pushing element, so that the second pushing element is pivotally coupled to the first pushing element.

In an embodiment, before the tail edges of the plural paper sheets are moved to the second end of the first sheet tray, the bulge allows the second pushing element not to be swung toward the second sheet tray.

In an embodiment, before the tail edges of the plural paper sheets are moved to the second end of the first sheet tray, the stopper of the first pushing element is engaged with the notch of the second pushing element, so that a position of the second pushing element is fixed.

In an embodiment, when the tail edges of the plural paper sheets reach the second end of the first sheet tray, a gravity of the bulge allows the second pushing element to be swung toward the second sheet tray.

In an embodiment, the sheet ejection device further includes a first shaft and a second shaft. The first shaft is disposed under the first end of the first sheet tray, wherein the first shaft is parallel with the first sheet tray and perpendicular to a transporting direction of the plural paper sheets. The second shaft is disposed under the second end of the first sheet tray, wherein the second shaft is parallel with the first sheet tray and perpendicular to the transporting direction of the plural paper sheets. The first shaft and the second shaft are enclosed by the ring-shaped conveyor belt, and the driving device is connected to the first shaft.

In an embodiment, the second pushing element of the sheet ejection arm is made of metallic material.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a post-processing apparatus with a sheet ejection device. By the sheet ejection device, plural paper sheets on a first sheet tray can be moved to a second sheet tray.

Figure 1:
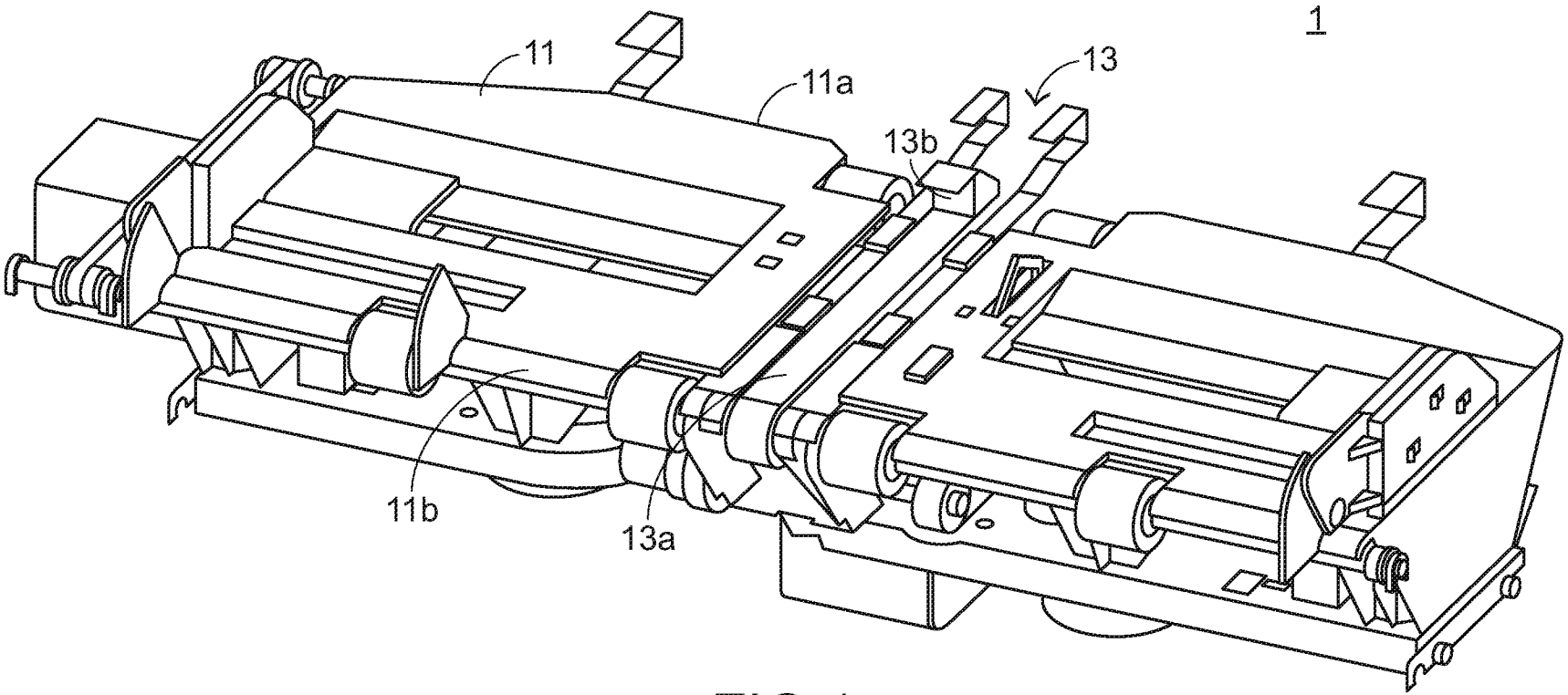
FIG.1 PRIOR ART
FIG. 1 is a schematic perspective view illustrating a conventional post-processing apparatus.
Figure 2:
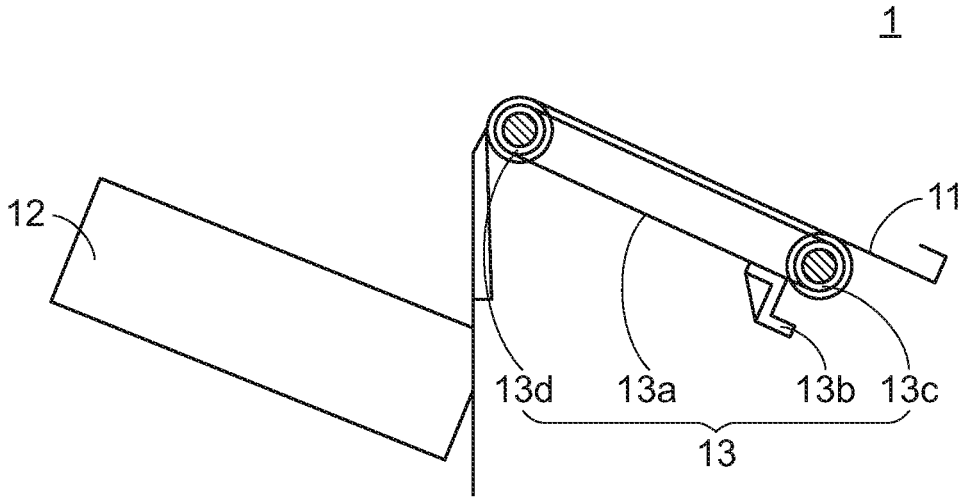
FIG.2 PRIOR ART
FIG. 2 is a schematic side view illustrating the conventional post-processing apparatus.
Figure 3A:
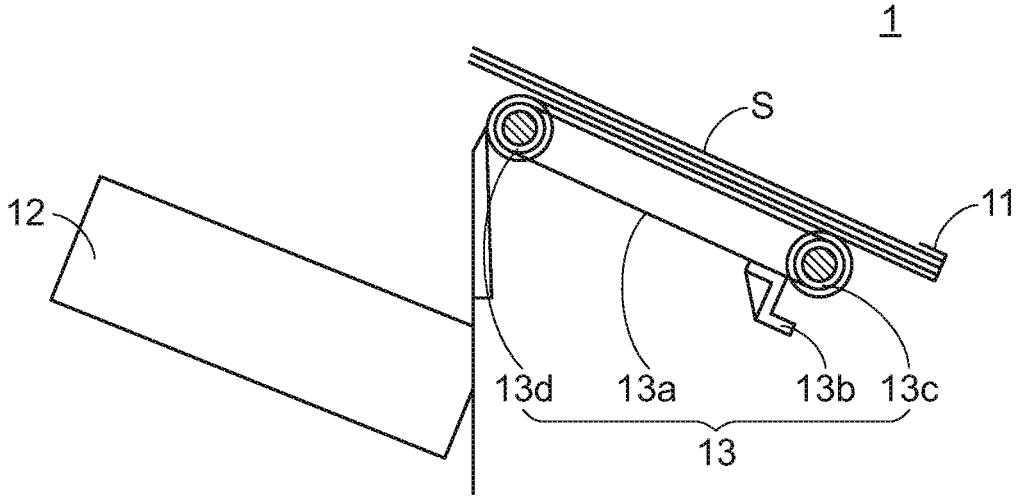
FIG.3A PRIOR ART
FIG. 3A is a schematic side view illustrating the conventional post-processing apparatus, in which the sheet ejection device is in an initial position.
Figure 3B:
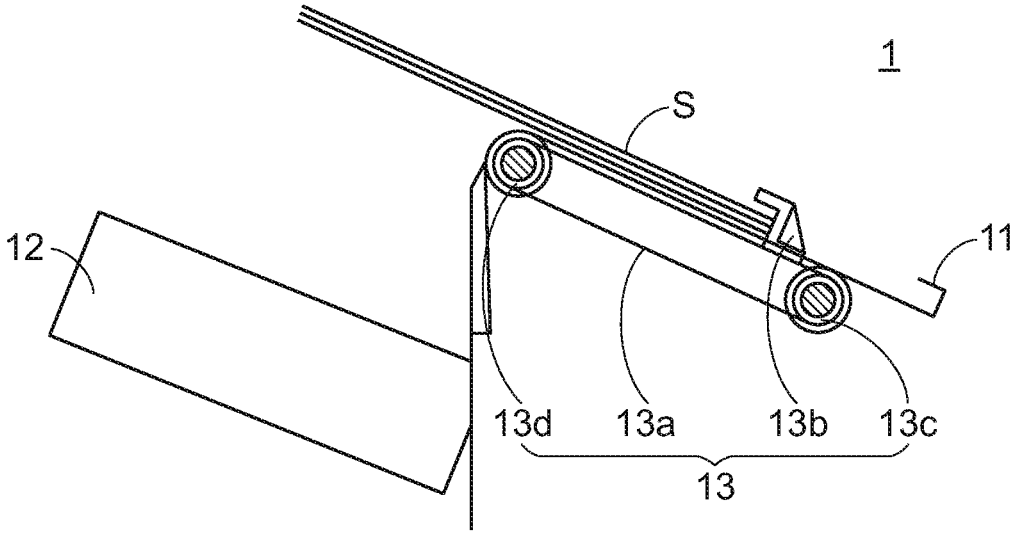
FIG.3B PRIOR ART
FIG. 3B is a schematic side view illustrating the conventional post-processing apparatus, in which plural paper sheets are pushed by the sheet ejection device.
Figure 3C:
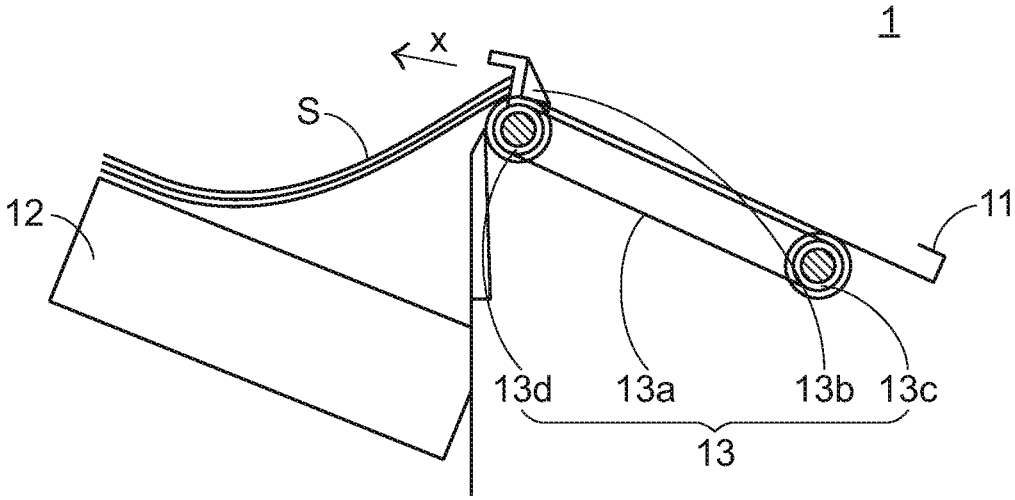
FIG.3C PRIOR ART
FIG. 3C is a schematic side view illustrating the conventional post-processing apparatus, in which the tail edges of the plural paper sheets are moved to the second end of the first sheet tray.
Figure 4:
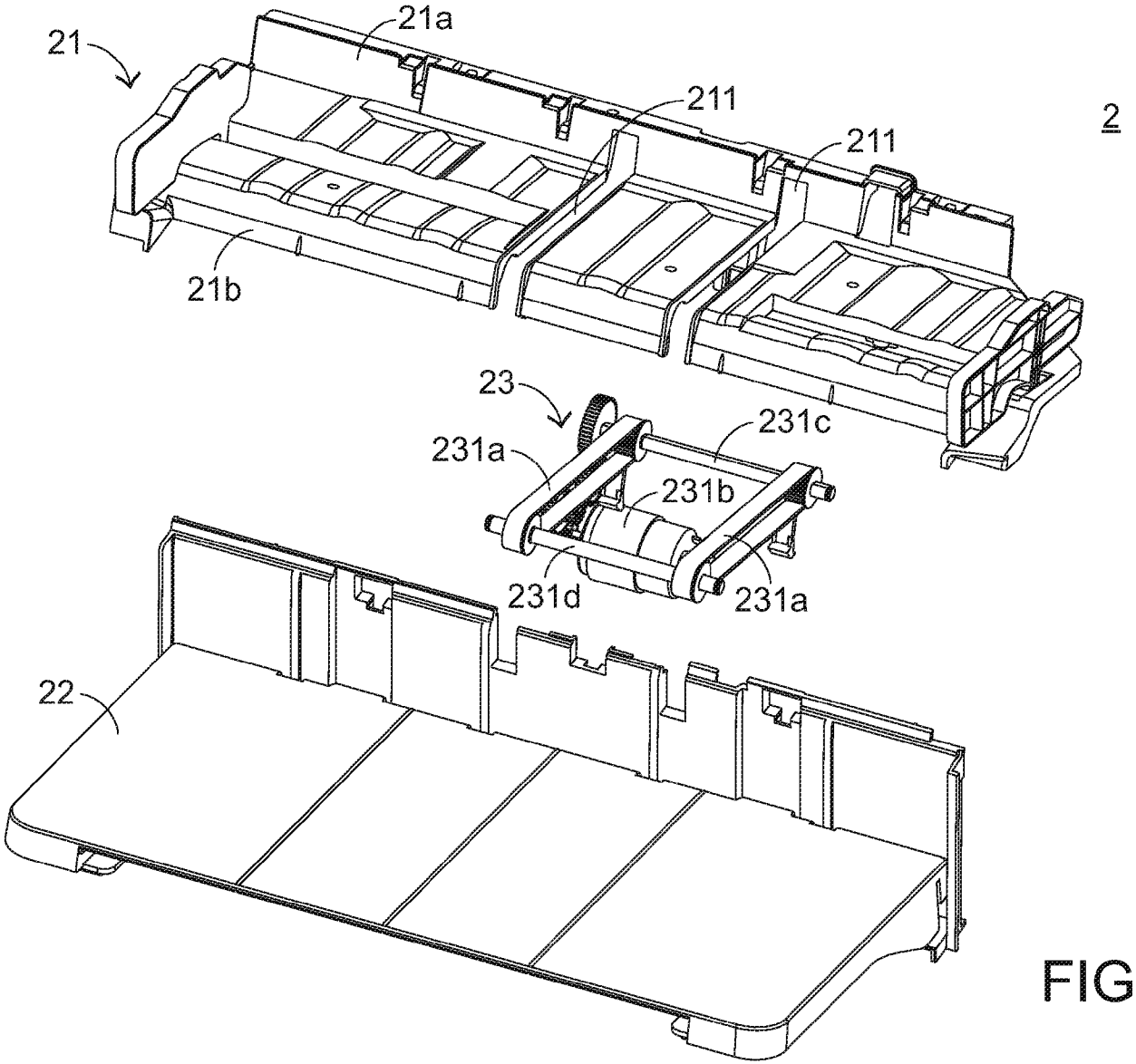
FIG. 4 is a schematic exploded view illustrating a post-processing apparatus according to an embodiment of the present invention.
Figure 5:
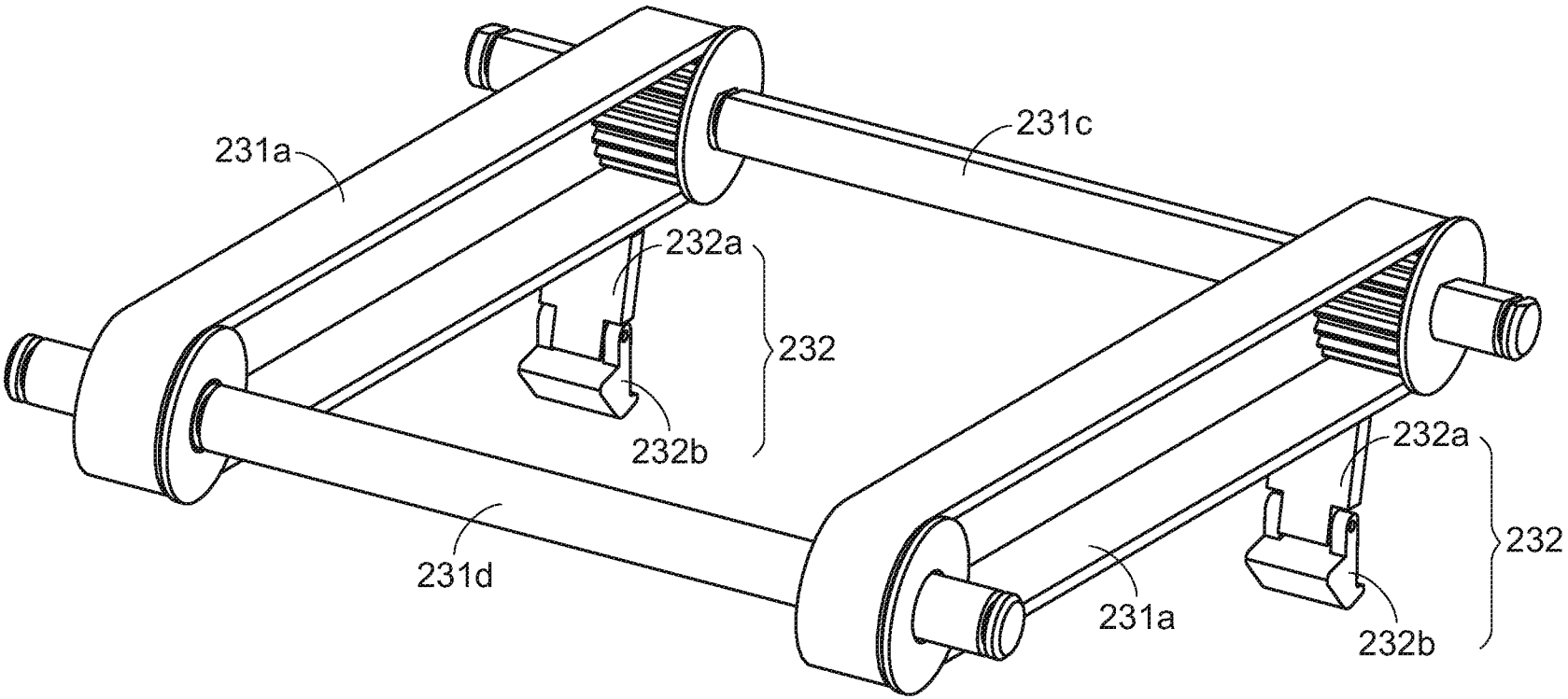
FIG. 5 is a schematic perspective view illustrating a ring-shaped conveyor belt, a first shaft, a second shaft and a sheet ejection arm of the post-processing apparatus of FIG. 4.

Hereinafter, the structure of a post-processing apparatus will be illustrated with reference to FIGS. 4 and 5. FIG. 4 is a schematic exploded view illustrating a post-processing apparatus according to an embodiment of the present invention. FIG. 5 is a schematic perspective view illustrating a ring-shaped conveyor belt, a first shaft, a second shaft and a sheet ejection arm of the post-processing apparatus of FIG. 4.

Please refer to FIGS. 4 and 5. The post-processing apparatus 2 comprises a first sheet tray 21, a second sheet tray 22, and a sheet ejection device 23. The sheet ejection device 23 is used for transmitting plural paper sheets from a first sheet tray 21 to a second sheet tray 22.

The first sheet tray 21 comprises an elongated groove 211. The elongated groove 211 is extended from a first end 21*a* of the first sheet tray 21 to a second end 21*b* of the first sheet tray 21. The sheet ejection device 23 comprises a ring-shaped conveyor belt 231*a*, a driving device 231*b*, a first shaft 231*c*, a second shaft 231*d*, and a sheet ejection arm 232. The sheet ejection arm 232 comprises a first pushing element 232*a* and a second pushing element 232*b*. It is preferred that the second pushing element 232*b* is made of metallic material.

Figure 6A:
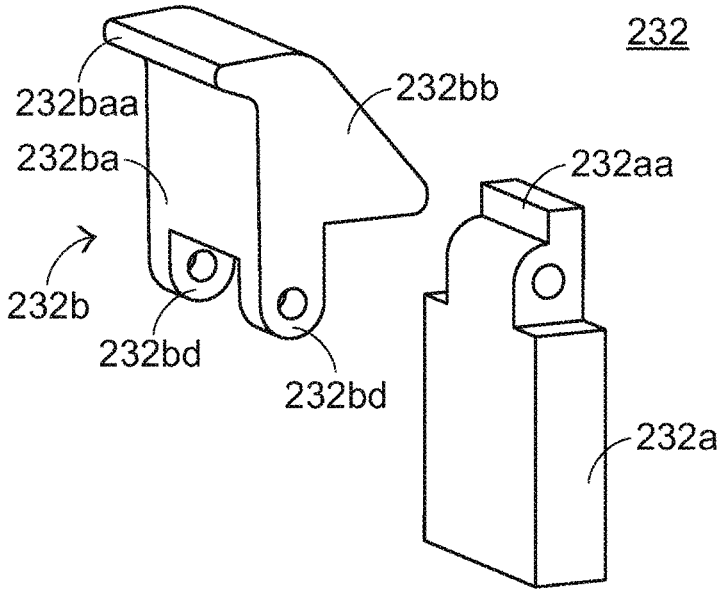
FIG. 6A is a schematic exploded view illustrating the sheet ejection arm of the post-processing apparatus according to an embodiment of the present invention and taken along a first viewpoint.
Figure 6B:
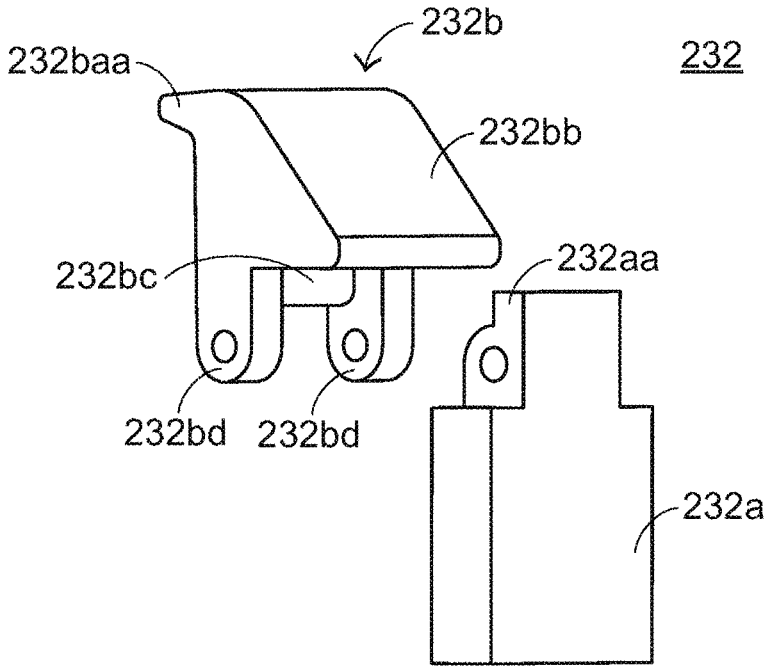
FIG. 6B is a schematic exploded view illustrating the sheet ejection arm of the post-processing apparatus according to an embodiment of the present invention and taken along a second viewpoint.

FIG. 6A is a schematic exploded view illustrating the sheet ejection arm of the post-processing apparatus according to an embodiment of the present invention and taken along a first viewpoint. FIG. 6B is a schematic exploded view illustrating the sheet ejection arm of the post-processing apparatus according to an embodiment of the present invention and taken along a second viewpoint.

Please refer to FIGS. 6A and 6B. The first pushing element 232*a* of the sheet ejection arm 232 comprises a stopper 232*aa*. The stopper 232*aa* is extended from a tip of the first pushing element 232*a* of the sheet ejection arm 232. The second pushing element 232*b* of the sheet ejection arm 232 comprises a sidewall 232*ba*, a bulge 232*bb*, a notch 232*bc*, and two coupling blocks 232*bd*. A hook 232*baa* is formed on a tip of the sidewall 232*ba*. The bulge 232*bb* is protruded from an opposite surface of the sidewall 232*ba*. The notch 232*bc* is disposed under the bulge 232*bb*. The two coupling blocks 232*bd* are located at a bottom of the second pushing element 232*b*.

Figure 7:
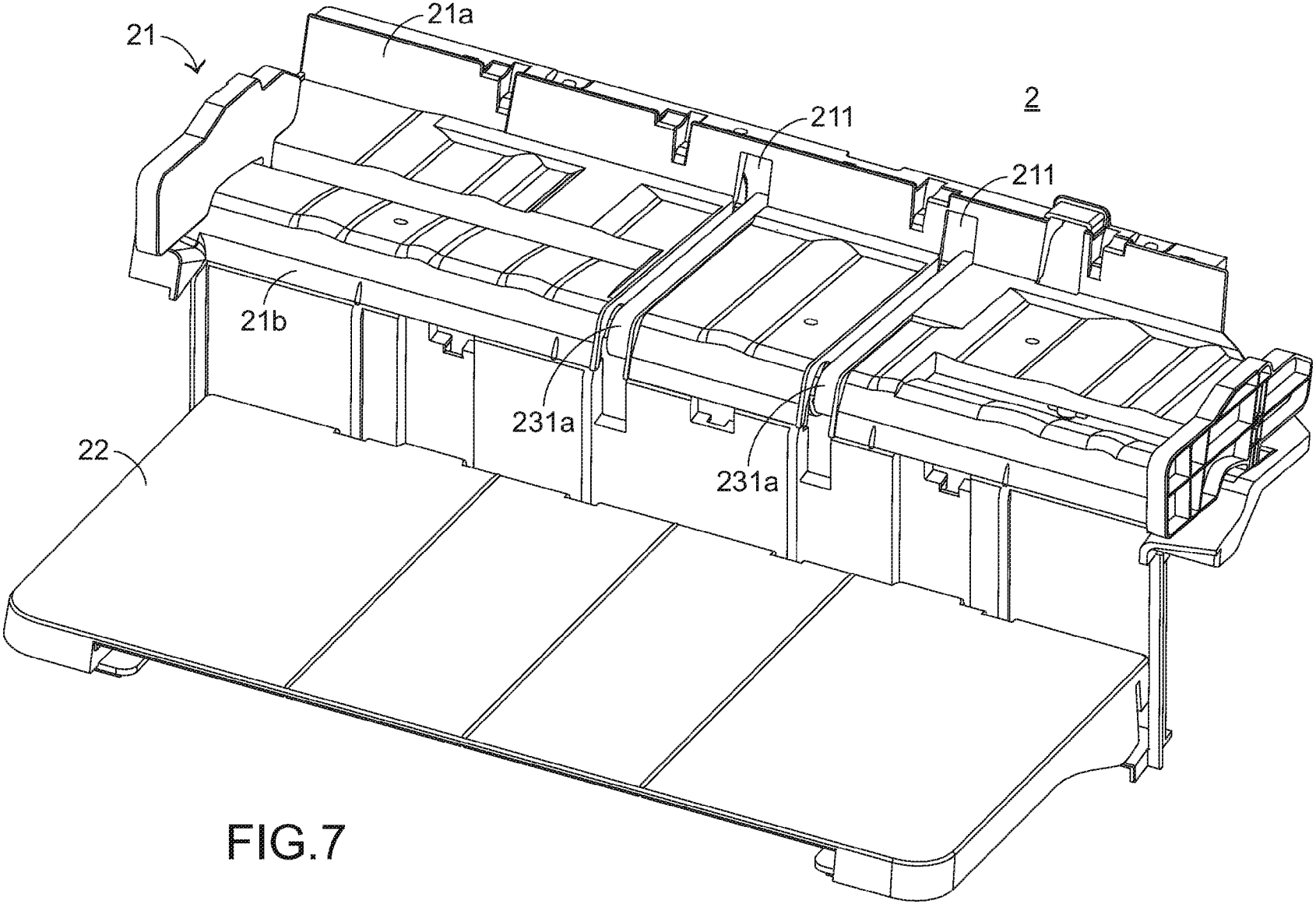
FIG. 7 is a schematic perspective view illustrating a post-processing apparatus according to an embodiment of the present invention.
Figure 8A:
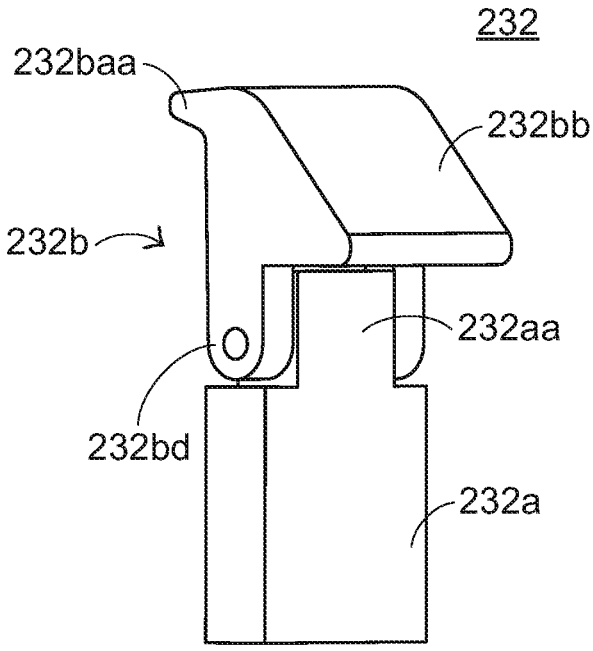
FIG. 8A is a schematic perspective view illustrating the sheet ejection arm of the post-processing apparatus according to an embodiment of the present invention and taken along a first viewpoint.
Figure 8B:
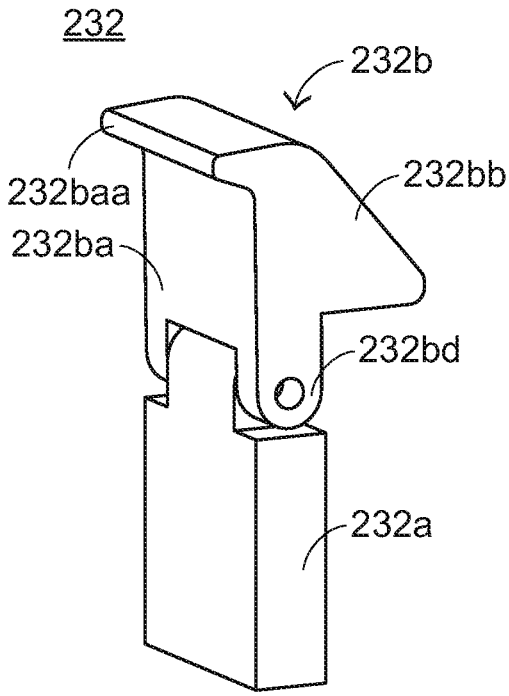
FIG. 8B is a schematic perspective view illustrating the sheet ejection arm of the post-processing apparatus according to an embodiment of the present invention and taken along a second viewpoint.

Hereinafter, a process of assembling the post-processing apparatus will be illustrated with reference to FIGS. 4, 5, 7, 8A and 8B. FIG. 7 is a schematic perspective view illustrating a post-processing apparatus according to an embodiment of the present invention. FIG. 8A is a schematic perspective view illustrating the sheet ejection arm of the post-processing apparatus according to an embodiment of the present invention and taken along a first viewpoint. FIG. 8B is a schematic perspective view illustrating the sheet ejection arm of the post-processing apparatus according to an embodiment of the present invention and taken along a second viewpoint.

The second sheet tray 22 is located beside the second end 21*b* of the first sheet tray 21. The first shaft 231*c* is disposed under the first end 21*a* of the first sheet tray 21. The second shaft 231*d* is disposed under the second end 21*b* of the first sheet tray 21. The first shaft 231*c* and the second shaft 231*d* are both parallel with the first sheet tray 21, and perpendicular to the transporting direction of plural paper sheets. In addition, the first shaft 231*c* and the second shaft 231*d* are enclosed by the ring-shaped conveyor belt 231*a*, and disposed under the elongated groove 211 of the first sheet tray 21. The driving device 231*b* is connected to the first shaft 231*c*. The first pushing element 232*a* of the sheet ejection arm 232 is protruded from an outer surface of the ring-shaped conveyor belt 231*a*. The two coupling blocks 232*bd* of the second pushing element 232*b* are pivotally coupled to the first pushing element 232*a* through the bilateral sides of the stopper 232*aa* of the first pushing element 232*a* (see FIGS. 8A and 8B). In addition, the second pushing element 232*b* may be swung relative to the first pushing element 232*a*.

As known, if the external force is not uniform during the process of transporting the paper sheet, the paper sheet is usually aslant transported. For maintaining equilibrium of the paper sheet, the sheet ejection device 23 of this embodiment comprises two ring-shaped conveyor belts 231*a*, two sheet ejection arms 232, and two elongated grooves 211. The configurations and functions of the two ring-shaped conveyor belts 231*a*, the two sheet ejection arms 232 and the two elongated grooves 211 are identical to each other, and are not redundantly described herein.

Figure 9:
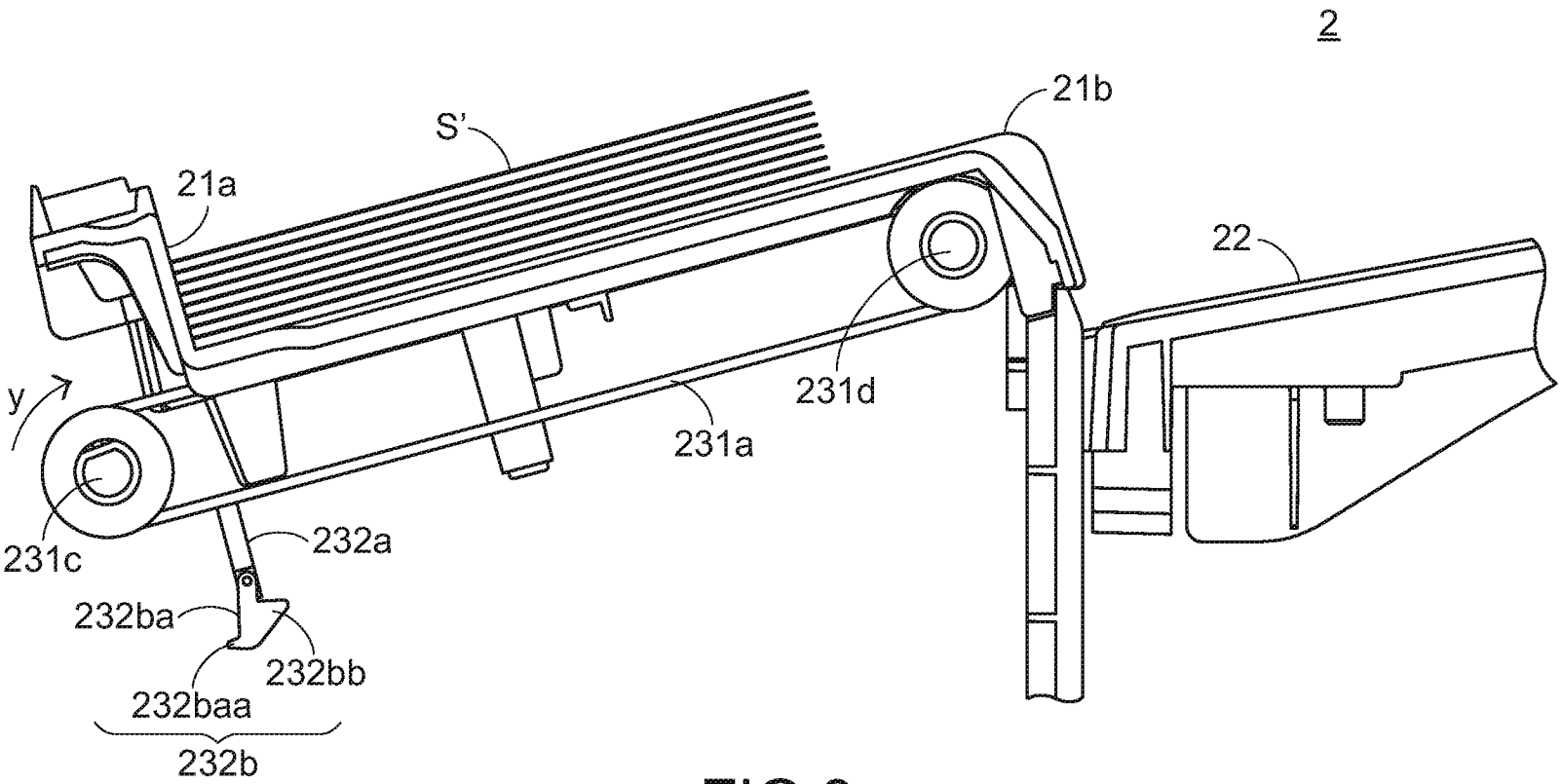
FIG. 9 is a schematic side view illustrating the post-processing apparatus according to an embodiment of the present invention, in which the sheet ejection device is in an initial position.
Figure 10:
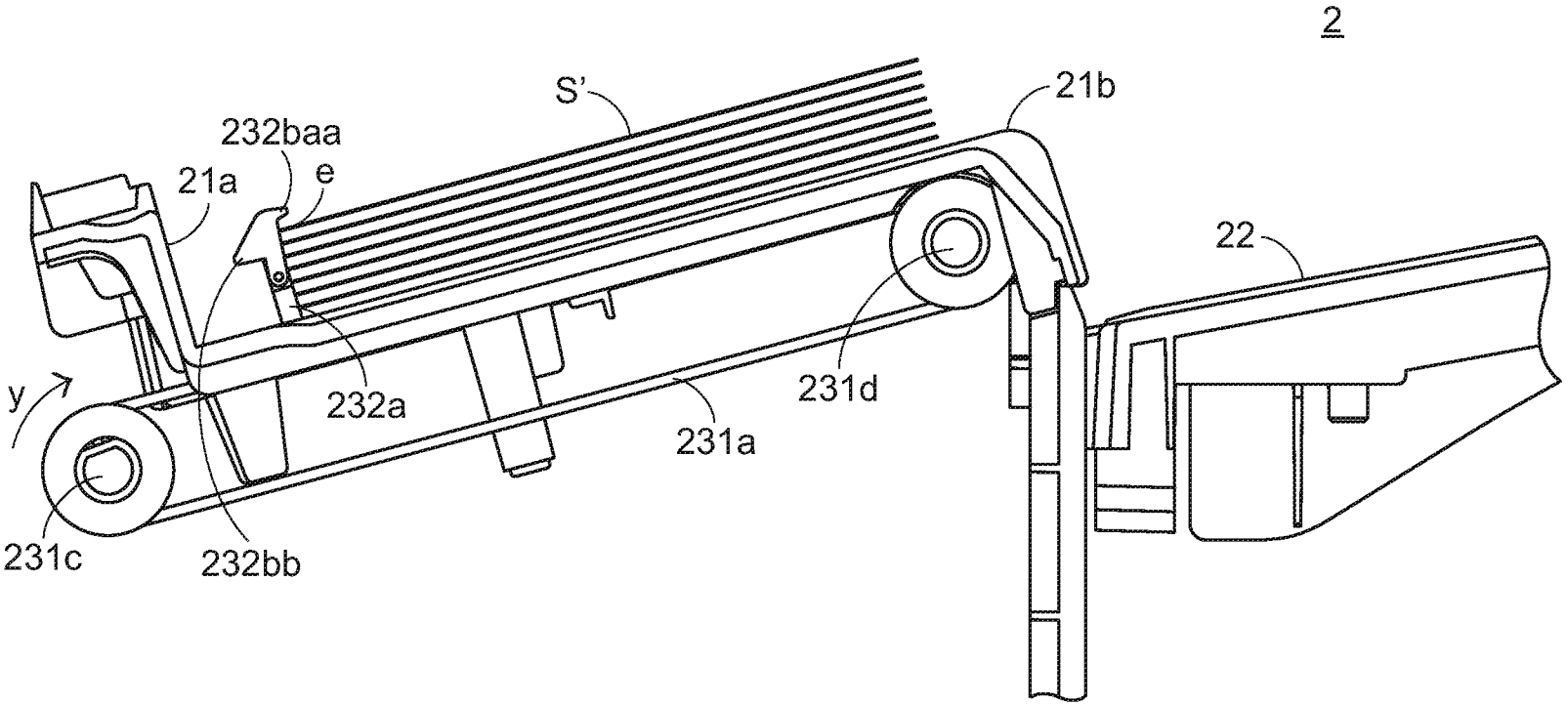
FIG. 10 is a schematic side view illustrating the post-processing apparatus according to an embodiment of the present invention, in which plural paper sheets are pushed by the sheet ejection device.
Figure 11:
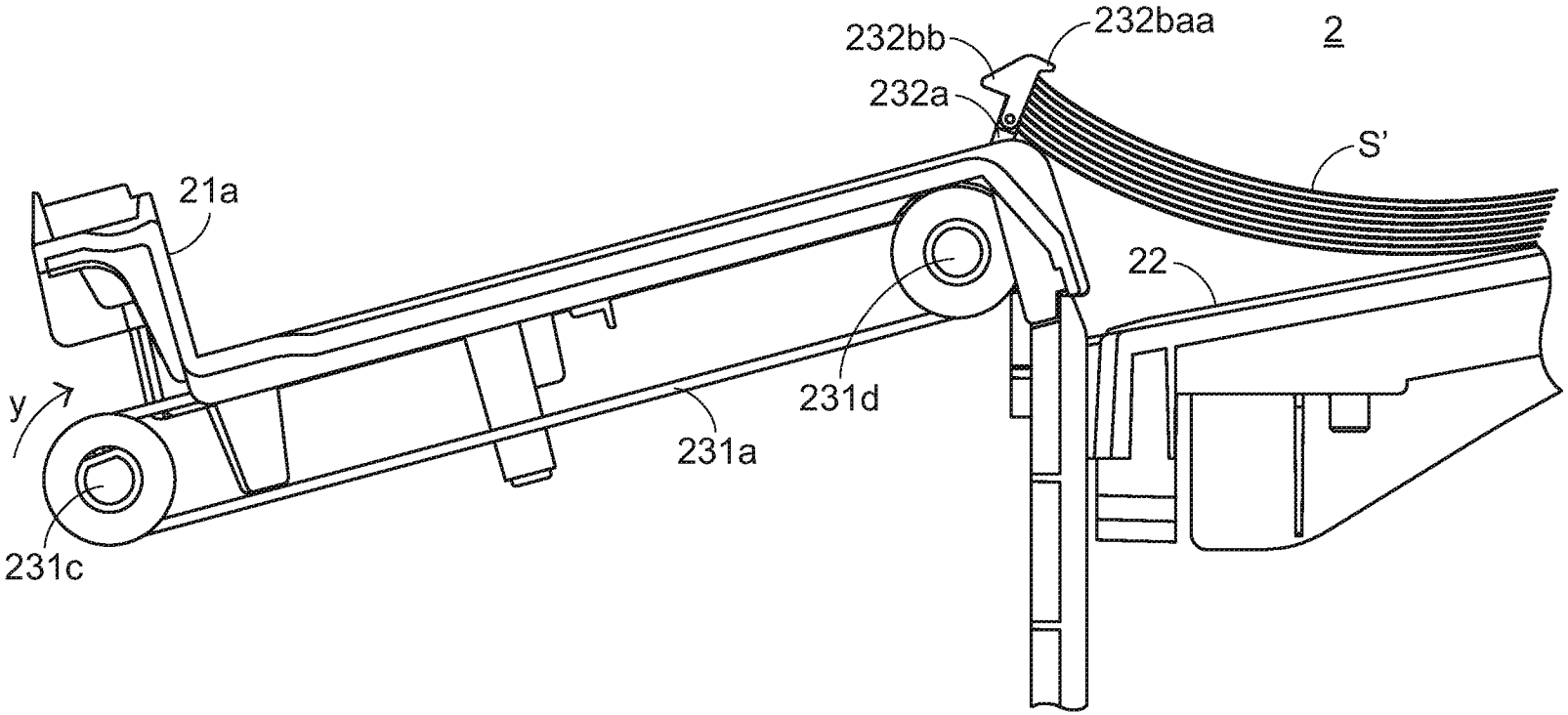
FIG. 11 is a schematic side view illustrating the post-processing apparatus according to an embodiment of the present invention, in which the tail edges of the plural paper sheets are moved to the second end of the first sheet tray.
Figure 12:
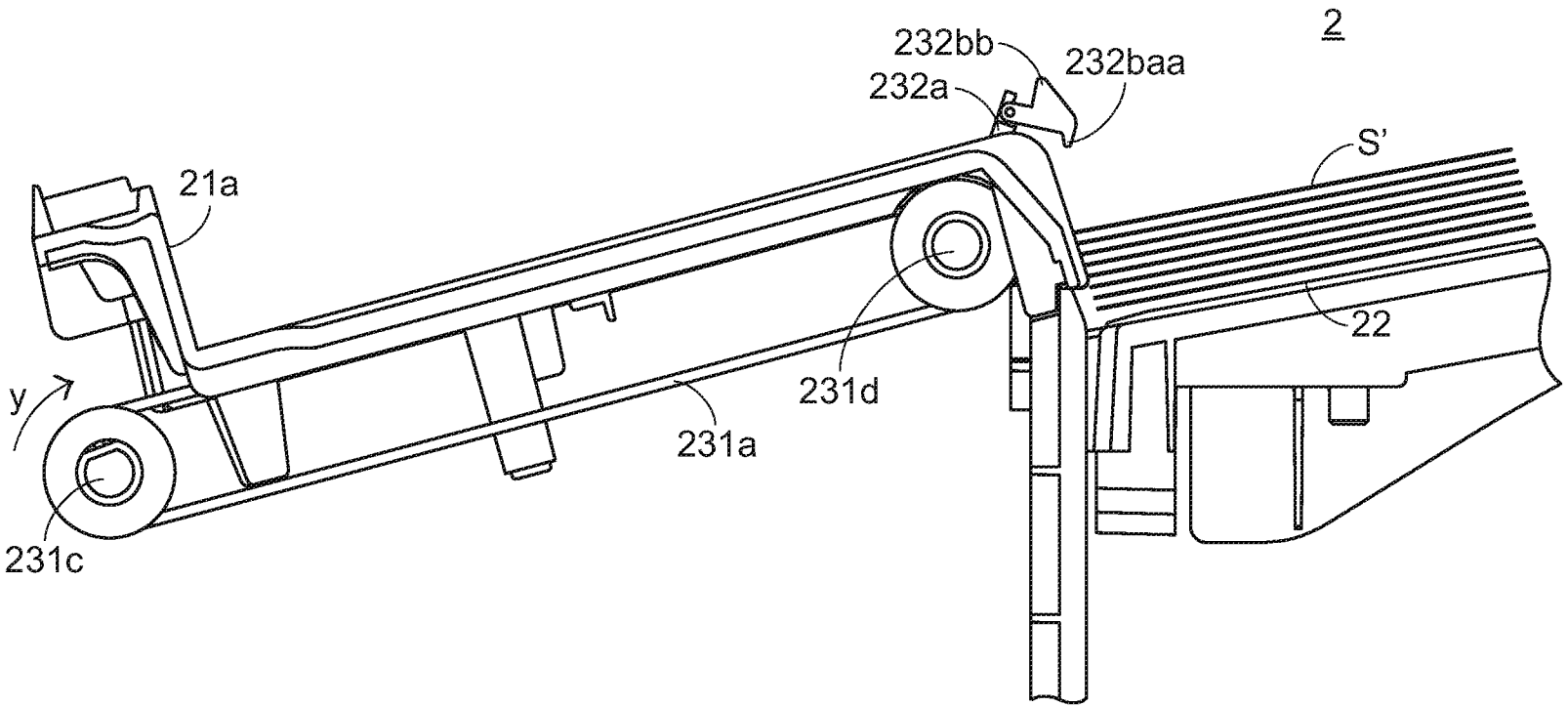
FIG. 12 is a schematic side view illustrating the post-processing apparatus according to an embodiment of the present invention, in which the second pushing element is rotated relative to the first pushing element to press the plural paper sheets into the second sheet tray.

Hereinafter, the operations of the sheet ejection device of the post-processing apparatus of the present invention will be illustrated with reference to FIGS. 9, 10, 11 and 12. FIG. 9 is a schematic side view illustrating the post-processing apparatus according to an embodiment of the present invention, in which the sheet ejection device is in an initial position. FIG. 10 is a schematic side view illustrating the post-processing apparatus according to an embodiment of the present invention, in which plural paper sheets are pushed by the sheet ejection device. FIG. 11 is a schematic side view illustrating the post-processing apparatus according to an embodiment of the present invention, in which the tail edges of the plural paper sheets are moved to the second end of the first sheet tray. FIG. 12 is a schematic side view illustrating the post-processing apparatus according to an embodiment of the present invention, in which the second pushing element is rotated relative to the first pushing element to press the plural paper sheets into the second sheet tray.

For clearly describing the operations of the sheet ejection device, the driving device 231*b* is not shown in FIGS. 9~12.

Firstly, as shown in FIG. 9, plural paper sheets S' outputted from the office machine are introduced into the first sheet tray 21 through the first end 21*a* of the first sheet tray 21, and sequentially stacked on the first sheet tray 21. Under this circumstance, the ring-shaped conveyor belt 231*a* is in a static state, and the sheet ejection arm 232 is stayed in an initial position, which is located under the first sheet tray 21.

Once the sheet-ejecting operation is started, the first shaft 231*c* is driven by the driving device 231*b* to be rotated in a direction y. Upon rotation of the first shaft 231*c*, the ring-shaped conveyor belt 231*a* is rotated in the direction y, so that the second shaft 231*d* is driven to be synchronously rotated in the direction y. Upon rotation of the ring-shaped conveyor belt 231*a*, the sheet ejection arm 232 is moved toward the region under the first shaft 231*c*.

When the sheet ejection arm 232 is moved across the first shaft 231*c* and moved to the first end 21*a* of the first sheet tray 21, the sheet ejection arm 232 is penetrated through the elongated groove 211 and exposed to the surface of the first sheet tray 21. Consequently, the tail edges e of the plural paper sheets S' on the first sheet tray 21 are simultaneously pushed by the first pushing element 232*a* and the sidewall 232*ba* of the second pushing element 232*b*.

As the sheet ejection arm 232 is continuously moved toward the second end 21*b* of the first sheet tray 21, the sheet ejection arm 232 will push the tail edges e of the plural paper sheets S' toward the second end 21*b* of the first sheet tray 21 (see FIG. 10). At the same time, the tail edge of the uppermost paper sheet is hooked by the hook 232*baa* at the tip of the sidewall 232*ba* of the second pushing element 232*b*. Consequently, the bending degrees of the plural paper sheets S' will be reduced, and the possibility of escaping the paper sheets S' out of the top side of the second pushing element 232*b* during the process of pushing the paper sheets S' will be minimized.

Moreover, before the tail edges e of the plural paper sheets S' reach the second end 21*b* of the first sheet tray 21, since the center of gravity of the second pushing element 232*b* is located at the side of the bulge 232*bb*, the second pushing element 232*b* is not swung relative to the second sheet tray 22. During this time period, the stopper 232*aa* of the first pushing element 232*a* is engaged with the notch 232*bc* of the second pushing element 232*b*, so that the position of the second pushing element 232*b* is fixed. Under this circumstance, the sidewall 232*ba* of the second pushing element 232*b* is maintained in parallel with the first pushing element 232*a* in order to push the plural paper sheets S'.

When the sheet ejection arm 232 is continuously moved to the region over the second shaft 231*d*, the tail edges e of the plural paper sheets S' are pushed to the second end 21*b* of the first sheet tray 21 (see FIG. 11). Meanwhile, the center-of-gravity position of the second pushing element 232*b* is changed. Due to the gravity of the bulge 232*bb*, the second pushing element 232*b* is swung toward the second sheet tray 22 (see FIG. 12).

At the time when the second pushing element 232*b* is swung, the tail edges e of the plural paper sheets S' are pressed by the second pushing element 232*b*. Under this circumstance, an instantaneous downward force is exerted on the tail edges e of the plural paper sheets S', thereby facilitating quickly introducing the tail edges e of the plural paper sheets S' into the second sheet tray 22.

Then, the sheet ejection arm 232 is continuously moved toward the region under the first sheet tray 21 until the sheet ejection arm 232 reaches the initial position.

In other words, when the tail edges e of the plural paper sheets S' reach the second end 21*b* of the first sheet tray 21, the change of the center-of-gravity position of the second pushing element 232*b* allows the tail edges e of the plural paper sheets S' to be quickly introduced into the second sheet tray 22.

From the above description, the present invention provides a sheet ejection device of a post-processing apparatus. After the plural paper sheets are completely detached from the first sheet tray, the second pushing element provides an instantaneous downward force to the tail edges of the plural paper sheets. Due to the instantaneous downward force, the tail edges e of the plural paper sheets can be quickly fallen down to the second sheet tray without being adversely affected by the pushing force of the sheet ejection arm.

Consequently, during the plural paper sheets are introduced into the second sheet tray, the possibility of flying the plural paper sheets in the sheet-pushing direction of the sheet ejection arm will be minimized. In other words, the operating speed of the sheet ejection arm may be increased, and thus the overall performance will be enhanced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A post-processing apparatus with a sheet ejection device for an office machine, said post-processing apparatus comprising:

a first sheet tray for storing plural paper sheets, wherein said first sheet tray comprises an elongated groove, and said elongated groove is extended from a first end of said first sheet tray to a second end of said first sheet tray;

a second sheet tray located beside and below said second end of said first sheet tray; and said sheet ejection device for transmitting said plural paper sheets from said first sheet tray to said second sheet tray, wherein said sheet ejection device comprising:

a ring-shaped conveyor belt disposed under said elongated groove of said first sheet tray;

a driving device for driving a circular movement of said ring-shaped conveyor belt; and a sheet ejection arm movable with said ring-shaped conveyor belt, so that movement of said ring-shaped conveyor belt causes said sheet ejection arm to move through said elongated groove from said first end of said first sheet tray to said second end of said first sheet tray, wherein said sheet ejection arm comprises a first pushing element and a second pushing element, said first pushing element is protruded from a surface of said ring-shaped conveyor belt, and said second pushing element is pivotally coupled to said first pushing element and pivots relative to said first pushing element under gravity influence, wherein after said sheet ejection arm is moved through said elongated groove from said first end of said first sheet tray, tail edges of said plural paper sheets are pushed by said first and second pushing elements of said sheet ejection arm, so that said plural paper sheets are moved toward said second end of said first sheet tray, wherein when said tail edges of said plural paper sheets reach said second end of said first sheet tray, said second pushing element pivots relative to said first pushing member under gravity influence toward said second sheet tray to press said tail edges of said plural paper sheets, so that said plural paper sheets are aligned with each other and smoothly fall down to said second sheet tray.

2. The post-processing apparatus according to claim 1, wherein said first pushing element further includes a stopper, which extends from a tip of said first pushing element.

3. The post-processing apparatus according to claim 2, wherein said second pushing element comprises:

a sidewall for contacting and pushing said plural paper sheets, wherein a hook is formed on an upper tip of said sidewall for preventing said plural paper sheets from escaping out of a top side of said second pushing element;

a bulge protruded from an opposite surface of said sidewall;

a notch disposed under said bulge; and two coupling blocks located at a bottom of said second pushing element, wherein said two coupling blocks are coupled to said stopper of said first pushing element, so that said second pushing element is pivotally coupled to said first pushing element.

4. The post-processing apparatus according to claim 3, wherein before said tail edges of said plural paper sheets are moved to said second end of said first sheet tray, said bulge creates a center-of-gravity position of said second pushing element that inhibits said second pushing element to pivot toward said second sheet tray under gravity influence.

5. The post-processing apparatus according to claim 4, wherein before said tail edges of said plural paper sheets are moved to said second end of said first sheet tray, said stopper of said first pushing element is engaged with said notch of said second pushing element, so that a position of said second pushing element is fixed.

6. The post-processing apparatus according to claim 3, wherein when said tail edges of said plural paper sheets reach said second end of said first sheet tray, said bulge creates a center-of-gravity position of said second pushing element that allows said second pushing element to pivot toward said second sheet tray under gravity influence.

7. The post-processing apparatus according to claim 1, wherein said sheet ejection device further comprises:

a first shaft disposed under said first end of said first sheet tray, wherein said first shaft is parallel with said first sheet tray and perpendicular to a transporting direction of said plural paper sheets; and a second shaft disposed under said second end of said first sheet tray, wherein said second shaft is parallel with said first sheet tray and perpendicular to said transporting direction of said plural paper sheets, wherein said first shaft and said second shaft are enclosed by said ring-shaped conveyor belt, and said driving device is connected to said first shaft.

8. The post-processing apparatus according to claim 1, wherein said second pushing element of said sheet ejection arm is made of metallic material.

* * * * *